US008713885B2

(12) United States Patent
Graham et al.

(10) Patent No.: US 8,713,885 B2
(45) Date of Patent: May 6, 2014

(54) PANEL FASTENER

(75) Inventors: Thomas Graham, Ocean, NJ (US); Martin P. Burns, Forked River, NJ (US)

(73) Assignee: Component Handware Group, Inc., Lakewood, NJ (US)

( * ) Notice: Subject to any disclaimer, the term of this patent is extended or adjusted under 35 U.S.C. 154(b) by 643 days.

(21) Appl. No.: 12/930,745

(22) Filed: Jan. 14, 2011

(65) Prior Publication Data

US 2012/0181799 A1 Jul. 19, 2012

(51) Int. Cl.
*E04B 2/06* (2006.01)
*B22D 19/00* (2006.01)

(52) U.S. Cl.
CPC .. *E04B 2/06* (2013.01); *B22D 19/00* (2013.01)
USPC ..... 52/582.2; 249/91

(58) Field of Classification Search
USPC ..... 249/83, 85, 91; 52/582.2
See application file for complete search history.

(56) References Cited

U.S. PATENT DOCUMENTS

| | | | | | |
|---|---|---|---|---|---|
| 2,714,751 | A | * | 8/1955 | Stuart et al. | 52/582.2 |
| 2,746,098 | A | * | 5/1956 | Cooper et al. | 52/582.2 |
| 3,365,851 | A | * | 1/1968 | Cushman | 52/580 |
| 3,400,958 | A | * | 9/1968 | Haimes et al. | 52/127.9 |
| 3,671,006 | A | * | 6/1972 | Berkowitz | 249/97 |
| 4,044,511 | A | * | 8/1977 | Lingle | 52/127.9 |
| 4,417,430 | A | * | 11/1983 | Loikitz | 52/582.2 |
| 4,512,122 | A | * | 4/1985 | Berkowitz | 52/127.9 |
| 5,212,924 | A | * | 5/1993 | Finkelstein | 52/582.2 |

* cited by examiner

*Primary Examiner* — Michael Safavi
(74) *Attorney, Agent, or Firm* — Francis C. Hand; Carella, Byrne, et al

(57) ABSTRACT

The housing of a panel fastener is provided with pockets along the upper edge of the elongated recess that receives a hook assembly or a pin assembly and pairs of locking elements are mounted in selected pairs of oppositely disposed pockets to engage adapters used in the foamed-in-place molding of a wall panel.

13 Claims, 7 Drawing Sheets

PANEL FASTENER

This invention relates to a panel fastener. More particularly, this invention relates to a panel fastener for securing wall panels together.

As is known, panel fasteners have been incorporated into the sides of panels that are to be connected together to form a wall or walls in various types of structures, for example, a refrigerator wall, as described in U.S. Pat. No. 3,671,006. In such constructions, the panel fasteners are located in the wall panels along the side edges and include a hook which can be rotated into or out of engagement with a cooperative pin in an adjacent panel. Typically, the panel fasteners are used in a foamed-in-place panel, such as described in U.S. Pat. Nos. 3,341,233, 3,472,545, 4,512,122 and 6,299,224 as well as published US Applications 2002/0092626 and 2008/0073913.

Generally, panel fasteners are made of metal with either a hook assembly sandwiched between a pair of plates or a pin secured between a pair of plates. The hook assembly usually has a hub rotatably mounted in the plates via a boss or the like in each plate, an eccentric mounted on the hub for rotation therewith and a hook mounted on the eccentric for rotation therewith. In addition, the hub is provided with a socket at each end to eventually receive a wrench. As the hub rotates under the turning force of a wrench, so also does the hook rotate. Upon engaging a pin in an oppositely mounted panel fastener and continued rotation, the eccentric rotates and the hook pulls back against the pin to provide a firm locking engagement between the hook and pin and, thus, the two oppositely disposed panel fasteners of two wall panels.

It has been known to fabricate a foamed-in-place panel by placing a rail along one edge of a wall panel, for example, made of metal or wood, fastening one or more adapters to the rail and then mounting a panel fastener on each adapter. Thereafter, a second wall panel is placed in opposition to the first panel to sandwich the rail and the panel fasteners therebetween and a foamable material is injected into the space between the wall panels and about the panel fasteners to complete the molding operation. Upon curing of the foamable material, the rail with the adapters is carefully pulled off the panel fasteners that are now firmly embedded within the foam between the wall panels.

The adapters used in the molding process serve to position the panel fasteners in precise locations relative to the panels to insure that the panel fasteners will mate properly with each other and also be in the proper orientation top to bottom to each other for correct orientation of the hook of one to the pin of the other.

Over the years, many manufacturers of panel fasteners have come and gone, and many had made proprietary panel fastener adapters, to assure the continued use of their brand rather than that of a competitor, since changing the adapters already installed on a set of panel molds is time-consuming. Thus, manufacturers of panel fasteners have had to manufacture and stock several varieties of fasteners, to suit the varied types of fastener adapters used by the many purchasers of these fasteners.

Accordingly, it is an object of the invention to provide a panel fastener which can fit multiple styles of panel fastener adapters.

It is another object of the invention to provide a panel fastener which can be stocked and then fitted with locking elements to fit various fastener adapters as orders are received.

It is another object of the invention to provide a multi-fit panel fastener that is relatively easy to make.

Briefly, the invention provides a panel fastener that employs a plastic shroud or housing that has an elongated recess for receiving a hook assembly or a pin assembly and a plurality of pairs of oppositely disposed pockets disposed on opposite sides of the recess for selectively receiving locking elements therein.

The locking elements are deployed in pairs in selected pockets of the panel fastener in order to attach the panel fastener housing to an adapter mounted on a mold panel for the molding of a wall panel.

In order to mount a locking element, each pocket of the panel fastener housing has a rear wall spaced from the plane of the recess and a slot that passes through the rear wall while each locking element has a bifurcated tang that extends through the slot. In addition, the bifurcated tang defines a pair of legs, each of which has a foot engaged against the rear wall of a pocket on a side opposite the recess to hold the locking element in the pocket. The mounting of each locking element in a selected pocket of the panel fastener is in the nature of a snap-fit.

When mounted in a pocket of the panel fastener, each locking element projects into the plane of the recess of the panel fastener housing. In addition, each locking element may have a slot disposed in parallel to the elongated recess of the panel fastener housing to allow flexing of the locking element during engagement and disengagement from an adapter mounted on the mold panel. Further, each locking element may have a rounded surface parallel to and projecting into the elongated recess of the panel fastener housing to facilitate movement over an adapter.

The panel fastener housing also has a plurality of raised ribs on an exterior thereof to provide an irregular surface for the foamed material that is to be foamed about the housing during fabrication of a wall panel. In addition, the panel fastener housing has a pair of sockets disposed at opposite ends of the recess to allow for alignment of oppositely facing panel fasteners of a pair of wall panels during assembly in the construction, for example, of an enclosed walk-in refrigerator or freezer.

The plastic panel fastener housing is particularly adapted to receive a plastic hook assembly or may be constructed to receive a pin assembly.

These and other objects and advantages of the invention will become more apparent from the following detailed description taken in conjunction with the accompanying drawings wherein.

Figure 1:
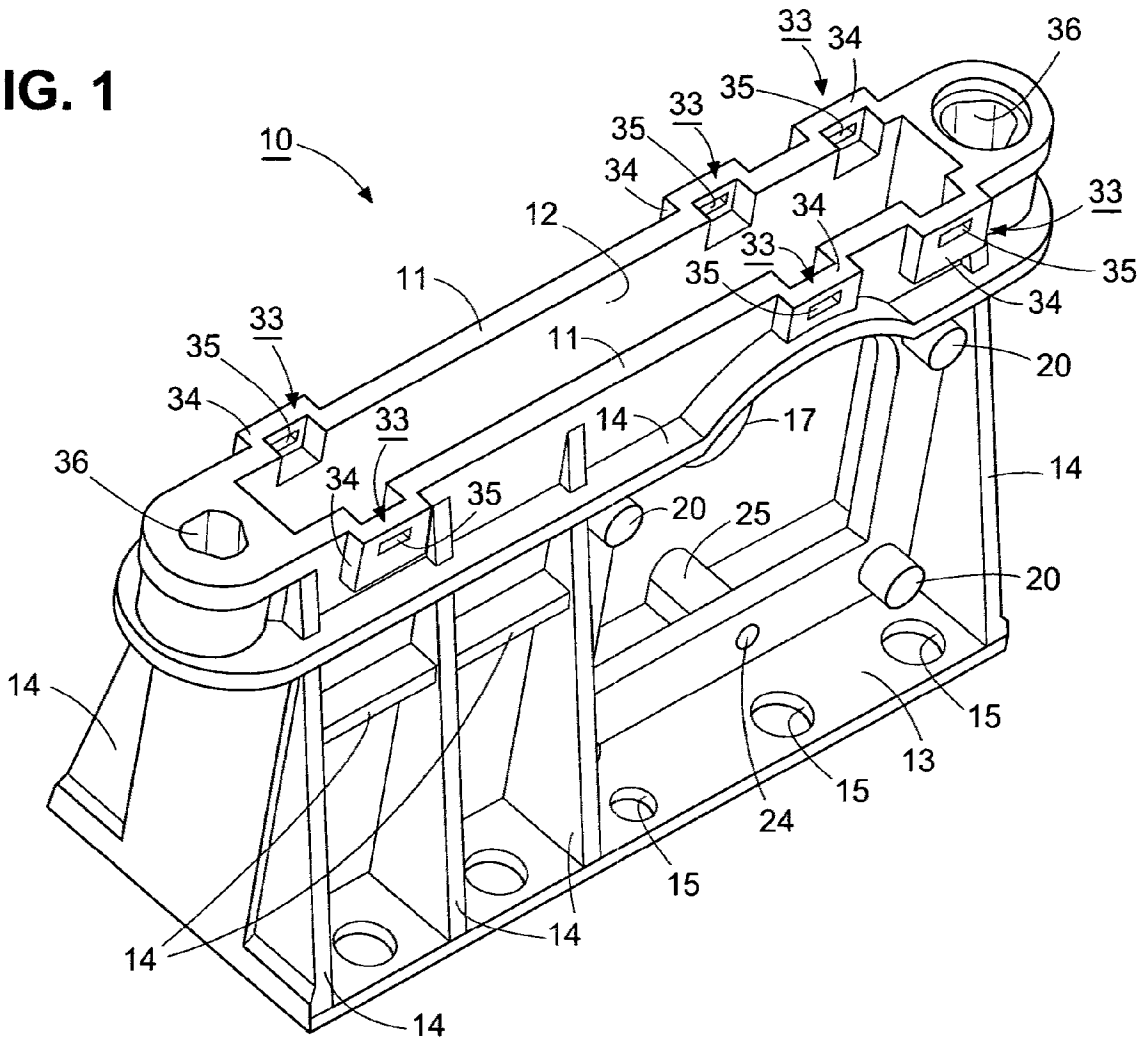
FIG. 1 illustrates a perspective view of a plastic housing for a panel fastener in accordance with the invention.

Referring to FIG. 1, the plastic housing (or shroud) 10 is constructed of plastic, such as a polystyrene plastic, to be of light weight, low cost and of one piece construction. The housing 10 includes a pair of parallel vertical side walls 11, as viewed, that bound an elongated recess 12 and a flat bottom that extends outwardly of the side walls 11 to form a pair of flanges 13 (only one of which is shown) perpendicular to the bottoms of the side walls 11. Each side wall 11 has a pattern of outstanding ribs 14 for molding, retention and strength purposes. The flanges 13 are provided with openings 15 for retention purposes when fabricating a foamed-in-place panel.

Figure 7:
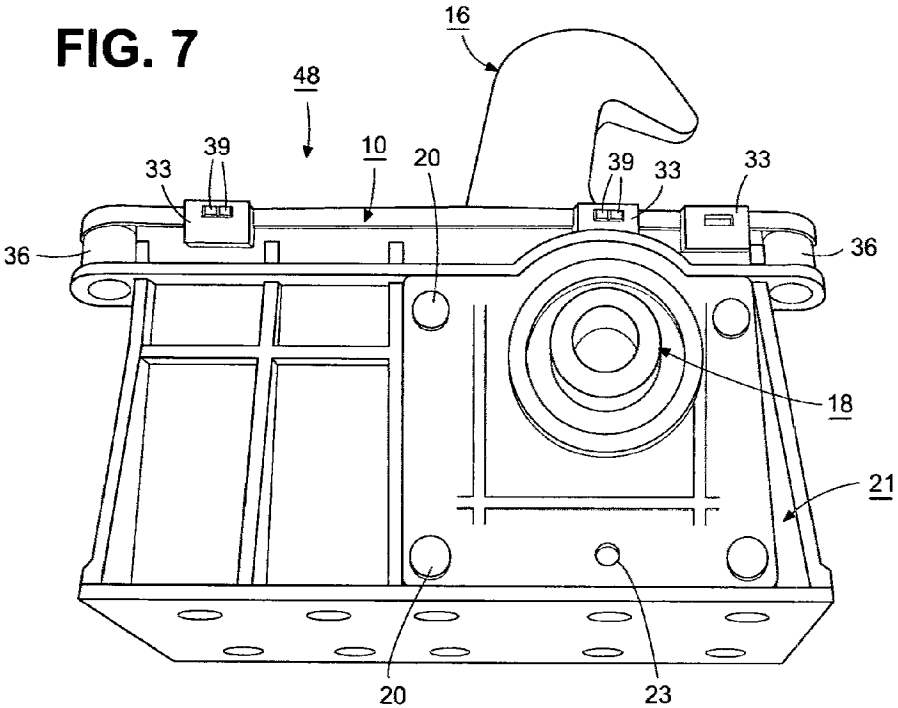
FIG. 7 illustrates a side view of a panel fastener employing the housing of FIG. 1 and a plastic hook assembly in accordance with the invention.

Referring to FIG. 7, where the housing 10 is to receive a hook assembly 16, one of the side walls 11 is provided with an opening 17 to receive one end of a hollow axle 18 of the hook assembly 16 in rotatable relation. The opposite side wall 11 of the housing 10 is provided with an enlarged opening 19 to provide access into the elongated recess 12 as well as four outstanding studs 20 disposed about the periphery of the opening 19 to receive a cover plate 21.

Figure 9:
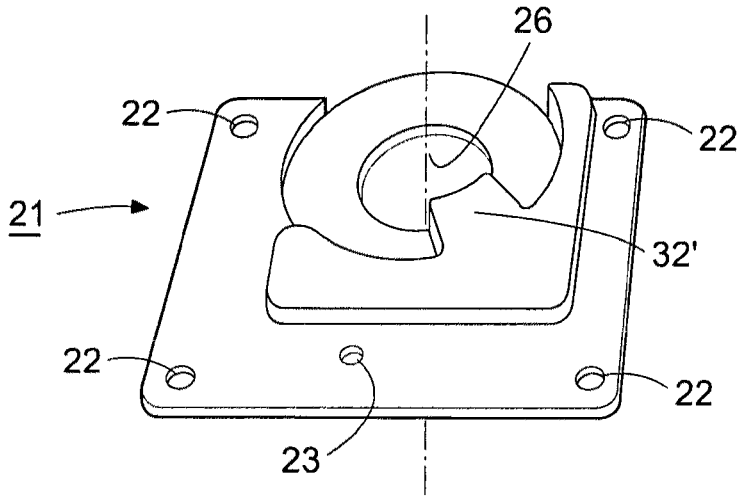
FIG. 9 illustrates a back side view of a cover for the panel fastener housing.

As illustrated in FIGS. 7 and 9, the cover plate 21 is made of a suitable plastic and is of a rectangular shape with four apertures 22 at the corners to fit over the studs 20 on the housing 10. The cover plate 21 also has an opening 23 that is aligned with a threaded bore 24 in a boss 25 in the housing 10 (see FIG. 1) in order to receive a self-threading screw (not shown) that secures the cover plate 21 on the housing 10.

The cover plate 21 also has an aperture 26 to receive the remaining and larger end of the hollow axle 18 of the hook assembly 16 in rotatable relation.

Figure 8:
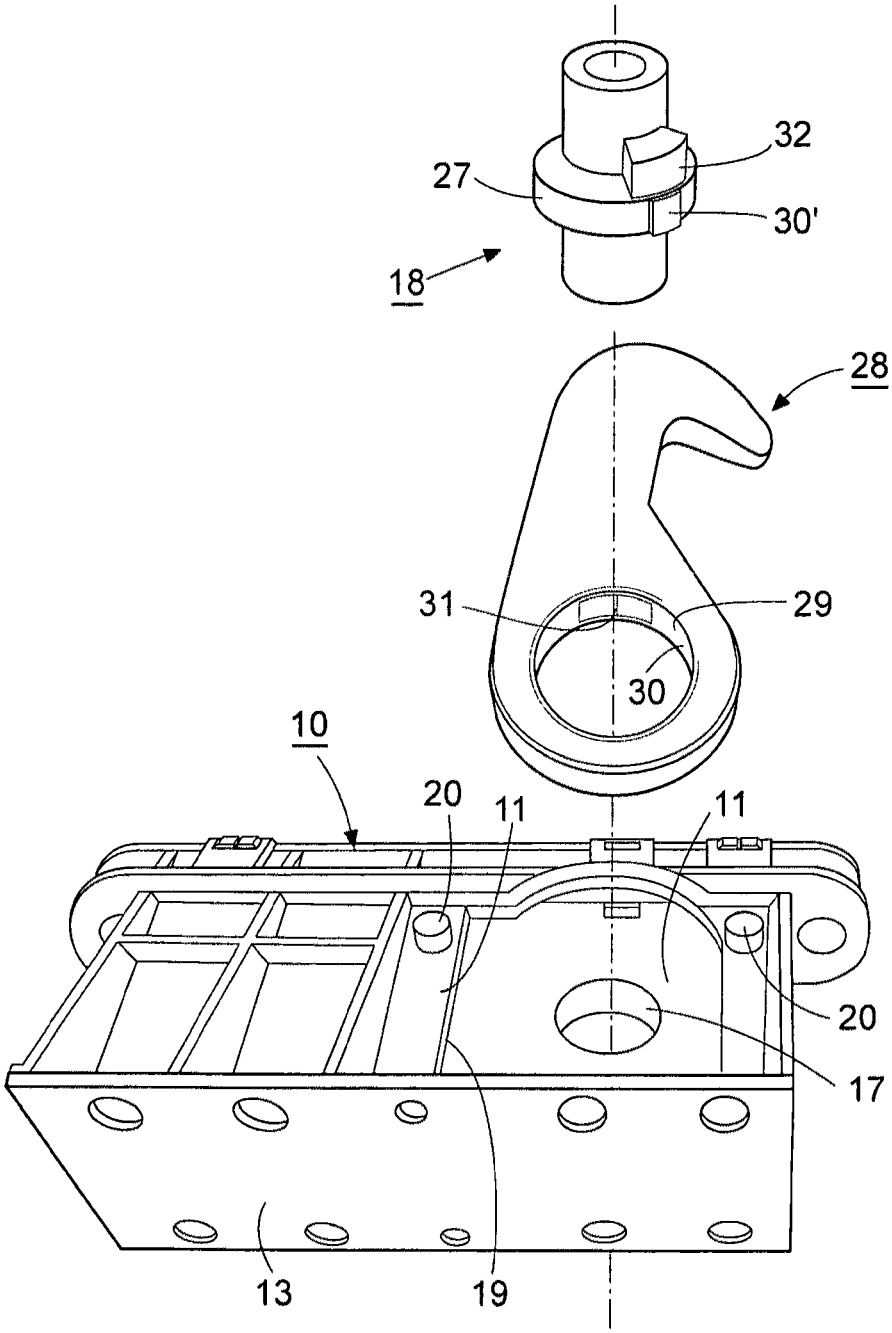
FIG. 8 illustrates an exploded view of the panel fastener of FIG. 7.

Referring to FIGS. 7 and 8, the hollow axle 18 of the hook assembly 16 is made of a suitable plastic and includes a cam surface 27 in the form of a raised collar of circular shape that is integrally formed on the remainder of the axle 18 on an axis that is radially offset from the axis of the remainder of the axle 18.

The hook assembly 16 also includes a hook 28 of conventional shape made of a suitably elastic plastic, such as acetal, and having a circular aperture 29 for mounting on the raised cam surface 27 of the axle 18 in rotatable relation such that the hook 28 rotates with the axle 18 when the axle 18 is rotated from an unlocked position towards a locked position when in use. In this regard, the inside wall of the hook 28 about the aperture 29 is provided with a raised surface 30 that is interrupted by a gap 31 extending over an angle, e.g. of about 60°, while the axle 18 is provided with a raised area 30' on the cam surface 27 that mates in the gap 31 when the hook 28 is mounted on the axle 18 at installation. Thus, the hook 28 is able to rotate with the axle 18 to move from a fully open position to a locking position where the hook 28 abuts a pin (not shown) of an opposed panel fastener. When the axle 18 is rotated further, the raised area 30' of the axle 18 climbs out of the gap 31 to slide along the raised surface 30 of the hook 28 thereby elastically deforming the hook 28 and creating a tight engagement between the hook 28 and the pin.

The axle 18 of the hook assembly 16 also has a block 32 extending radially outwardly of the axle 18 and laterally of the cam surface 27. This block 32 moves within an arcuate slot in the rear face of the cover plate 21 (see FIG. 8) to abut against an abutment 32' which limits rotation of the axle 18. When the block 32 abuts against one side of the abutment 32', the hook 28 is in an open position, i.e. the hook 28 is fully retracted within the housing 10. When the block 32 abuts against the opposite side of the abutment 32', the hook 28 is in a closed position, i.e. where the hook 28 tightly locks onto the pin (not shown) of an opposed panel fastener.

Referring to FIG. 1, the housing 10 is provided with pairs of oppositely disposed pockets 33 disposed in the upper ends of the sidewalls 11 on opposite sides of and in open communication with the elongated recess 12. Each pocket 33 has a rear wall 34 spaced from the plane of the recess 12 and a slot 35 that passes through the rear wall 34. As indicated, there are three pairs of pockets 33. However, any other suitable number of pockets 33 may be formed in the housing 10. As indicated, the pocket pairs are located at different points along the length of the recess 12.

The housing 10 also has a pair of sockets 36 disposed at opposite ends of the recess 12 to allow for alignment of oppositely facing panel fasteners as is known.

Figure 2:
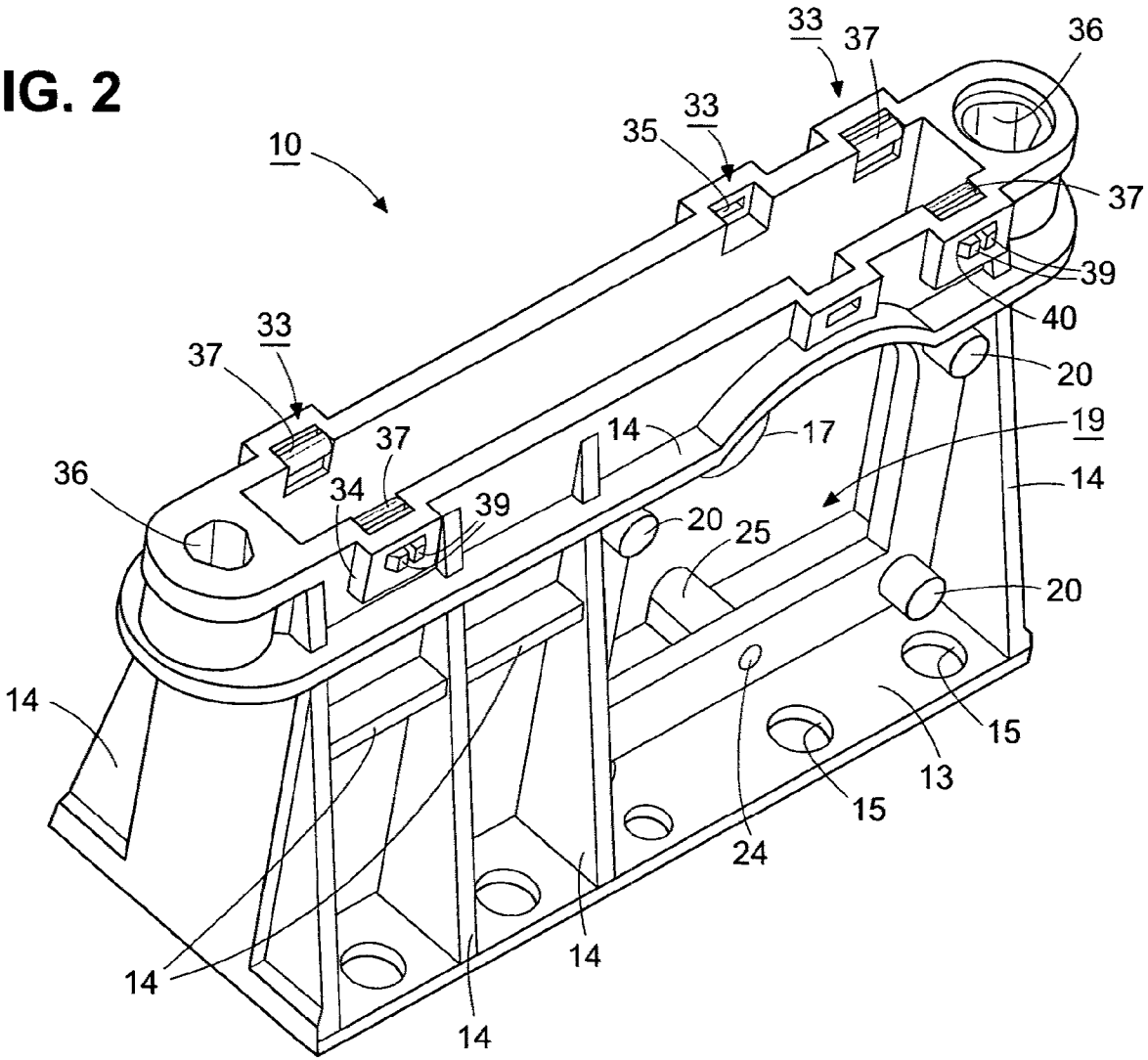
FIG. 2 illustrates a perspective view of the plastic housing of FIG. 1 with two pairs of locking elements in place in accordance with the invention.
Figure 3:
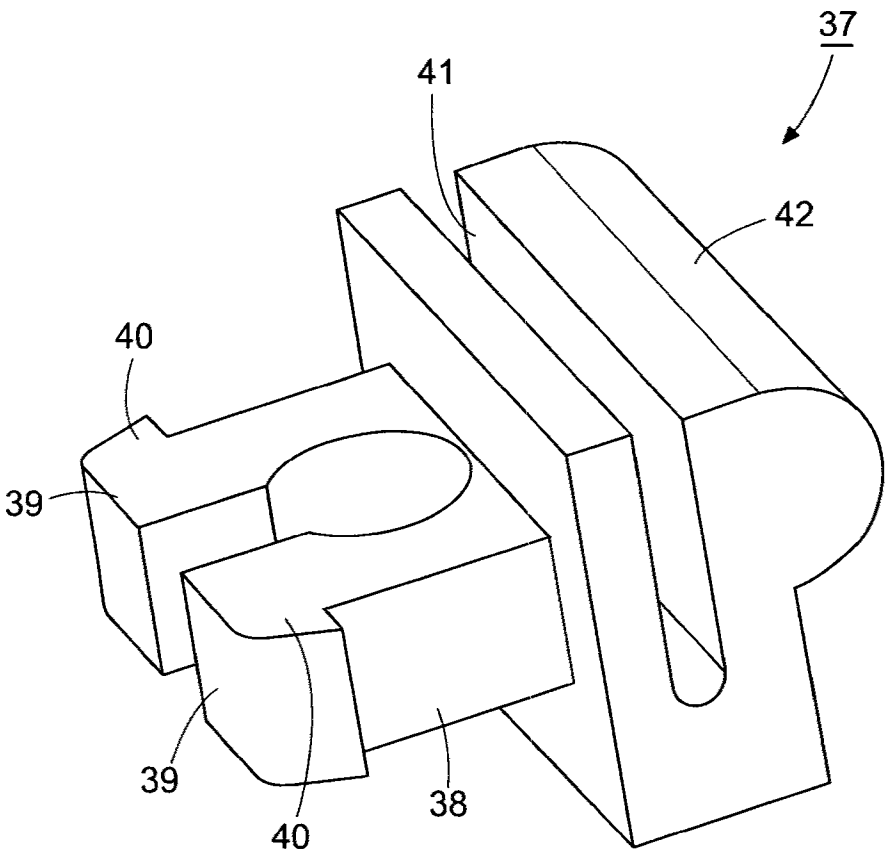
FIG. 3 illustrates a perspective view of a locking element in accordance with the invention.

Referring to FIGS. 2 and 3, the plastic housing 10 is shown with two pairs of locking elements 37 in the outermost pockets 33 with each locking element 37 projecting into the plane of the recess 12. Each locking element 37 has a bifurcated tang 38 that extends through the slot 35 in the rear wall 34 of a pocket 33 and that defines a pair of legs 39. As shown in FIG. 3, each leg 39 has a foot 40 that engages against the rear wall 34 of the pocket 33 on a side opposite the recess 12 to hold the locking element 37 in the pocket. Each locking element 37 may also have a slot 41 disposed in parallel to the elongated recess 12 to allow flexing of the locking element 37 thereat as well as a rounded surface 42 parallel to and projecting into the elongated recess 12.

Each locking element 37 is made of a plastic, such as polystyrene or Nylon, so as to be snap-fitted into a pocket 33.

Figure 4:
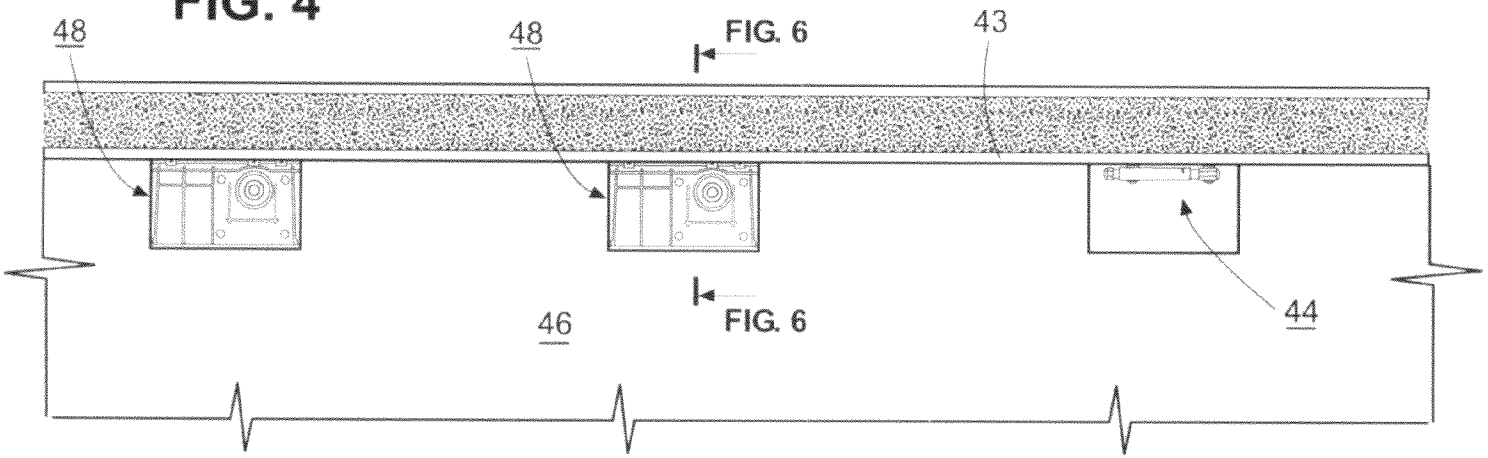
FIG. 4 illustrates a view of a plurality of panel fasteners according to the invention mounted on a rail secured along an edge of a mold panel for a wall panel during fabrication.

Referring to FIG. 4, during fabrication of a wall panel for a wall, for example, for a walk-in refrigerator cabinet, four rails 43 (only one of which is shown) are mounted in a molding frame in a rectangular manner with at least one rail 43 having one or more adapters 44 (see FIG. 5) of conventional structure secured thereon in a conventional manner, as by threaded bolts 45. Typically, a wall panel 46 is disposed to one side of the frame of rails 43 to form one side of the fabricated wall panel.

Figure 5:
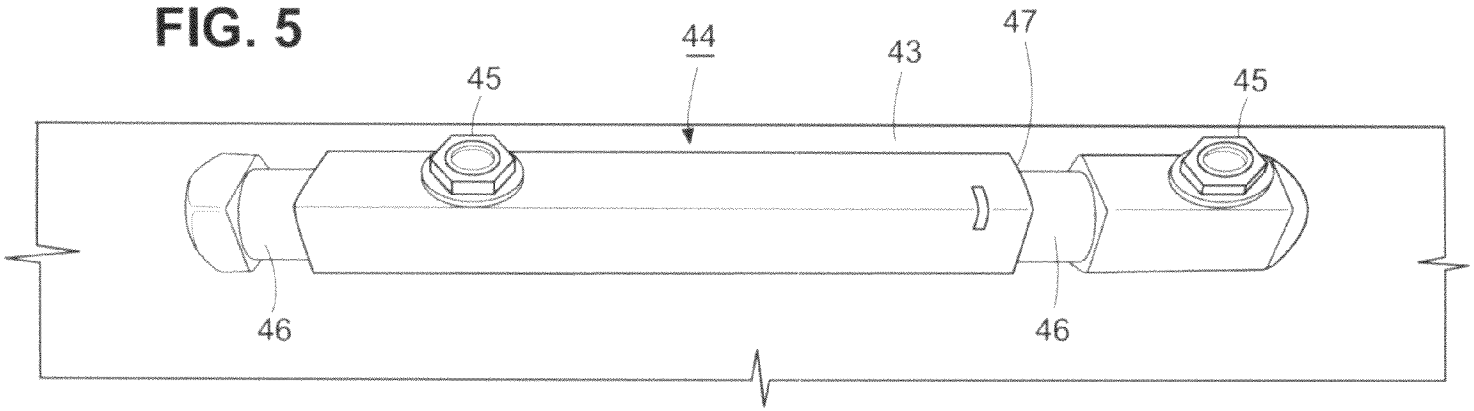
FIG. 5 illustrates a view of an adapter for the mounting of the panel fastener of FIG. 5 on the rail for the mold panel of FIG. 4.

As shown in FIG. 5, each adapter 44 is in the form of a bar of rectangular cross-section with a pair of reduced cylindrical sections 46 that form grooves 47 at precise locations along the length of the adapter.

In accordance with the invention, as shown in FIG. 4, a plurality of panel fasteners 48, each composed of a housing 10 containing a hook assembly 18 or a housing 10 modified to have a pin (not shown), are mounted on the adapters 44 located along the rail 43. To this end, the housing 10 of each panel fastener 48 is provided with two pairs of locking elements 37, for example, being placed in the two outermost pockets 33 of the housing 10. The housing 10 is then snap-fitted about a respective adapter 44 with the two pairs of locking elements 37 embracing the adapter 44 within the grooves 47 and holding the housing 10 firmly against the rail 43, as illustrated in FIG. 6, while extending from the adapter 44 perpendicularly of the rail 43.

Figure 6:
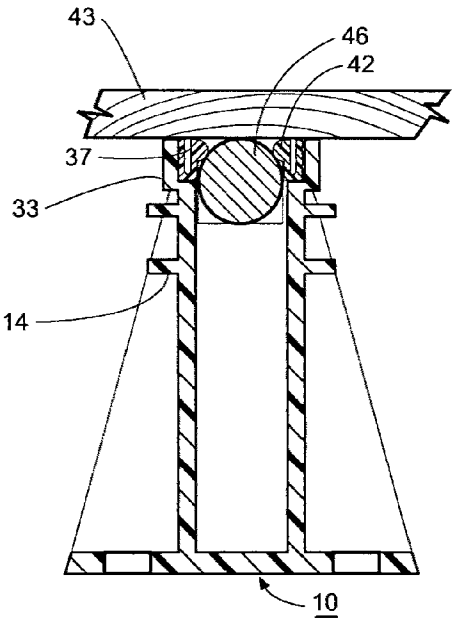
FIG. 6 illustrates a view taken on line 6-6 of FIG. 4.

As indicated in FIG. 6, each locking element 37 projects into a groove 47 of an adapter 44 such that the rounded surface 42 of the locking element 37 projects into and is located in a gap between the reduced cylindrical section 46 of the adapter 44 and the rail 43 to firmly hold the housing 10 to the adapter 44.

After a second wall panel is placed in opposition to the first panel 46 to sandwich the rails 43 and the panel fasteners 48 therebetween, a foamable material is injected into the space between the wall panels and about the panel fasteners 48 to complete the molding operation of a wall panel in a conventional manner. Upon curing of the foamable material, each rail 43 with the adapters 44 is carefully pulled off the panel fasteners 48 that are now firmly embedded within the foam between the wall panels.

In the event the adapters mounted on the rail 43 are of a shorter length than previously used adapters, the two pairs of locking elements 37 are placed in the pockets 33 of the housing 10 that are closer together. In the case of an even shorter length of adapter, only one pair of holding elements 37 need be used and this pair may be placed in the central-most pair of pockets 33.

The housing 10 may also be made to accommodate a pin assembly. In this embodiment, the walls of the housing 10 are not apertured to receive the cover plate 21 or axle 18 of a hook assembly 16 but instead are adapted to receive a pin for engagement by a hook 28.

The invention thus provides a panel fastener which can fit multiple styles of panel fastener adapters. The invention further provides a panel fastener which can be stocked and then fitted with locking elements to fit various fastener adapters as orders are received.

The invention also provides a multi-fit panel fastener that is relatively easy to make and that is made entirely of plastic.

What is claimed is:

1. A panel fastener comprising a plastic housing having an elongated recess for receiving one of a hook assembly and a pin assembly, and a plurality of pairs of oppositely disposed pockets disposed on opposite sides of said recess for selectively receiving locking elements therein; and at least one locking element mounted in a respective one of said pockets and projecting into said recess.

2. A panel fastener as set forth in claim 1 wherein said respective one of said pockets has a rear wall spaced from said recess and a slot passing through said rear wall and said one locking element has a bifurcated tang extending through said slot in said rear wall and defining a pair of legs, each said leg having a foot thereon engaged against said rear wall on a side opposite said recess to hold said locking element in said respective one of said pockets.

3. A panel fastener as set forth in claim 2 wherein said locking element has a slot therein disposed in parallel to said elongated recess to allow flexing of said locking element thereat.

4. A panel fastener as set forth in claim 3 wherein said locking element has a rounded surface parallel to and projecting into said elongated recess.

5. A panel fastener comprising a one piece plastic housing having an elongated recess for receiving one of a hook assembly and a pin assembly, and at least one pair of oppositely disposed pockets disposed on opposite sides of said recess; and at least one pair of locking elements for engaging an adapter of a panel mold therebetween, each said locking element being selectively mounted in a respective pocket of one of said pair of oppositely disposed pockets and projecting into said recess.

6. A panel fastener as set forth in claim 5 wherein each pocket of said pair of oppositely disposed pockets has a rear wall spaced from said recess and a slot passing through said rear wall and each locking element of said pair of locking elements has a bifurcated tang extending through said slot in said rear wall of a respective pocket and defining a pair of legs, each said leg having a foot thereon engaged against said rear wall on a side opposite said recess to hold said locking element in said respective pocket.

7. A panel fastener as set forth in claim 6 wherein each said locking element has a rounded surface parallel to and projecting into said elongated recess.

8. A panel fastener as set forth in claim 7 wherein said locking element has a slot therein disposed in parallel to said elongated recess to allow flexing of said locking element thereat.

9. A panel fastener as set forth in claim 5 wherein said housing has a plurality of raised ribs on an exterior thereof and a pair of sockets disposed at opposite ends of said recess.

10. The combination of at least one rail for a mold frame;

at least one adapter secured to said rail and having a pair of grooves disposed along the length thereof; and a panel fastener mounted on said adapter and extending from said adapter perpendicularly of said rail, said a panel fastener having an elongated recess for receiving one of a hook assembly and a pin assembly, a plurality of pairs of oppositely disposed pockets disposed on opposite sides of said recess and at least one locking element mounted in a respective one of said pockets and projecting into one of said pair of grooves of said adapter.

11. The combination as set forth in claim 10 wherein said respective one of said pockets has a rear wall spaced from said plane of said recess and a slot passing through said rear wall and said one locking element has a bifurcated tang extending through said slot in said rear wall and defining a pair of legs, each said leg having a foot thereon engaged against said rear wall on a side opposite said recess to hold said locking element in said respective one of said pockets.

12. The combination as set forth in claim 11 wherein said locking element has a rounded surface parallel to and projecting into said one of said pair of grooves of said adapter.

13. The combination as set forth in claim 12 wherein said locking element has a slot therein disposed in parallel to said elongated recess to allow flexing of said locking element thereat.

* * * * *